US006556849B2

(12) United States Patent
Zhou et al.

(10) Patent No.: US 6,556,849 B2
(45) **Date of Patent: *Apr. 29, 2003**

(54) SWITCHABLE SUPERCONDUCTIVE INDUCTOR

(75) Inventors: Shu-Ang Zhou, Älvsjö (SE); Erland Wikborg, Danderyd (SE)

(73) Assignee: Telefonaktiebolaget LM Ericsson (publ), Stockholm (SE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

This patent is subject to a terminal disclaimer.

(21) Appl. No.: 09/353,649

(22) Filed: Jul. 15, 1999

(65) Prior Publication Data

US 2002/0044027 A1 Apr. 18, 2002

(30) Foreign Application Priority Data

Jul. 17, 1998 (SE) ..... 9802583

(51) Int. Cl.[7] ..... H01P 3/08; H01B 12/02

(52) U.S. Cl. ..... 505/210; 333/99.005; 333/238

(58) Field of Search ..... 333/995, 238, 333/246; 505/210, 700, 701, 866

(56) References Cited

U.S. PATENT DOCUMENTS 4,943,559 A * 7/1990 Severin et al. ..... 505/701 X
6,041,245 A * 3/2000 Mansour ..... 333/995 X

OTHER PUBLICATIONS

*Physical Review Letters,* vol. 58, No. 9, Mar. 2, 1987, pp. 908–910, M. K. Wu, et al., "Superconductivity at 93 K in a New Mixed–Phase Y–Ba–Cu–O Compound System at Ambient Pressure".

*IEEE Transactions on Applied Superconductivity*, vol. 2, No. 4, Dec. 1992, pp. 228–235, Pierre Hartemann, "Effective and Intrinsic Surface Impedances of High–$T_c$ Superconducting Thin Films".

* cited by examiner

*Primary Examiner*—Benny T. Lee
(74) *Attorney, Agent, or Firm*—Nixon & Vanderhye, PC

(57) ABSTRACT

An inductor for microwave frequencies has a substantially planar structure and is constructed of a transmission line designed as a linear microstrip element made of a central line comprising normal electrically conducting material, such as a suitable metal. The microstrip element has a width which is varied by making areas at sides of the central line superconducting. By changing the effective width of the microstrip, the inductance of the microstrip is changed accordingly. The areas at the sides of the microstrip element in the non-superconducting state may have some electrical conductivity. However, because they contact the central metal conductor only at a very narrow edge, instead of contacting it at a large surface, the side superconducting areas do not significantly affect the transmission characteristics of the transmission path when the superconducting areas are in the normal state.

13 Claims, 1 Drawing Sheet

SWITCHABLE SUPERCONDUCTIVE INDUCTOR

FIELD OF THE INVENTION

The present invention relates to an inductor to be used in microwave integrated circuits, in particular an inductor being formed by a microstrip line.

BACKGROUND OF THE INVENTION

In transmission paths in microwave integrated circuits, there is a need for various components such as inductors. In particular, there may be a need for an inductor, the characteristics of which can be varied, such as an inductor which can be switched between two inductance values as controlled by an electrical signal.

In Japanese patent application JP 2/101801, a microwave band-rejection filter is disclosed having transmission lines designed as linear microstrip, metal elements placed on top of an area of a layer of superconducting material. The superconducting material area has a pattern substantially agreeing with that of the metal conductor, except in some regions where the width of the superconducting area is larger than that of the metal conductor. When the superconducting material is in a non-superconducting state, most of the electric current passes through the common metal material of the metal conductor, whereas, in superconducting state, the electrical current passes only through the superconducting underlying material. The microstrip metal elements thereby obtain a variable filtering effect. However, a disadvantage of this design resides in providing a region having some, though it may be low, electrical conductivity placed under the normal conductor, since this region causes losses in the transmission line. The conductivity of materials, which are superconducting at a low temperature and are suitable for microwave integrated circuits, have in their normal state an electrical conductivity corresponding to some $10^{-3}$ to $10^{-2}$ times that of the electrical conductivity of the material of the always normal metal conductor.

SUMMARY OF THE INVENTION

It is an object of the invention to provide an electrical inductor of the microstrip type for microwaves exhibiting low losses.

An inductor for primarily microwave frequencies is constructed of a transmission line designed as a linear microstrip element made of a central line comprising normal electrically conducting material, such as a suitable metal. The microstrip element has a width which is varied by making areas at the sides of the central line superconducting. By changing the effective width of the microstrip, the inductance thereof is changed accordingly. The areas at the sides of the microstrip element are electrically connected along at least portions of the sides or of the edges of the central metal conductor. These superconducting areas, in their non-superconducting state, have some electrical conductivity which can be rather low. However, because they contact the central metal conductor only at a very low, thin or narrow edge, instead of contacting it at a large surface, they do not significantly affect the transmission characteristics of the transmission path when the superconducting areas are in the normal, not superconducting state.

Additional objects and advantages of the invention will be set forth in the description which follows, and in part will be obvious from the description, or may be learned by practice of the invention. The objects and advantages of the invention may be realized and obtained by means of the example and non-limiting methods, processes, instrumentalities and combinations particularly pointed out in the appended claims.

BRIEF DESCRIPTION OF THE DRAWINGS

While the novel features of the invention are set forth with particularly in the appended claims, a complete understanding of the invention, both as to organization and content, and of the above and other features thereof may be gained from and the invention will be better appreciated from a consideration of the following detailed description of non-limiting embodiments presented hereinbelow with reference to the accompanying drawings, in which:

DETAILED DESCRIPTION OF THE INVENTION

Figure 1:
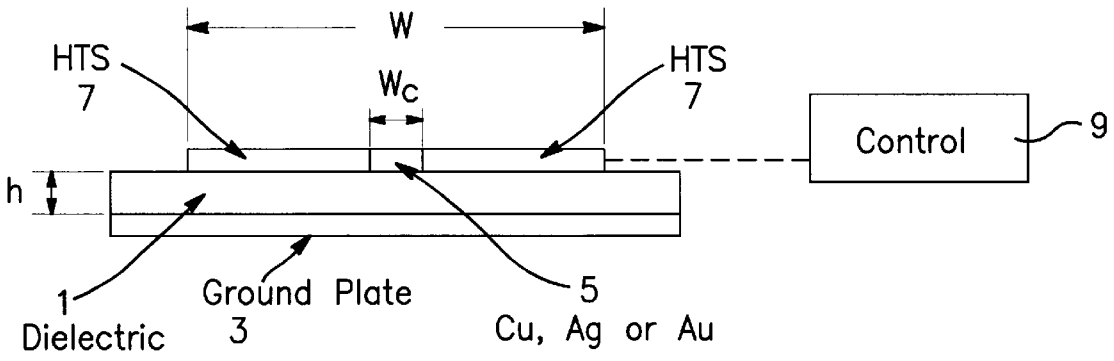
FIG. 1 is a cross-sectional view of a planar, switchable microwave inductor.

In the cross-sectional view of FIG. 1 an inductor having a variable inductance intended to be connected in e.g., a microwave circuit is illustrated. The inductor is built on a dielectric substrate 1 having an electrically conducting ground plane layer 3, such as a metal layer of e.g. Cu, Ag or Au, on its bottom surface, the ground plane layer covering substantially all of the bottom surface as a contiguous layer. On the top surface there is a patterned electrically conducting layer 5 having a high electrical conductivity, such as a suitable metal, e.g., of the same metal as the bottom layer, i.e. of copper (Cu), silver (Ag) or gold (Au). The patterned layer 5 has a uniform width $W_c$ and forms a transmission or propagation path for microwaves. The strip 5 has electrically conducting areas or regions 7 located directly at the side or sides of the conductor strip 5. These regions 7 are made of a potentially superconducting material, preferably a high temperature superconducting (HTS) material. The regions 7 comprise strips located at both sides of the central metallic strip 5, preferably symmetrically in relation thereto, these strips thus having the same uniform width. The width of the superconducting strips together with the central conductor is denoted by W.

In the "normal" state, the potentially superconducting regions 7 may have, e.g., an electrical conductivity $\sigma_n$ of about $5 \cdot 10^5$ S/m. The electrical conductivity $\sigma_c$ of the central metal conductor 5 may be, e.g., about $10^8$ S/M. When the potentially superconducting regions 7 are in the normal state, electrical current flows almost entirely in the central conductor 5. The current distribution (J) for this normal, non-superconducting state appears from the diagram of FIG. 2*b*. The current distribution (J) is here substantially uniform over the width $W_c$ of the conductor 5.

Figure 2A:
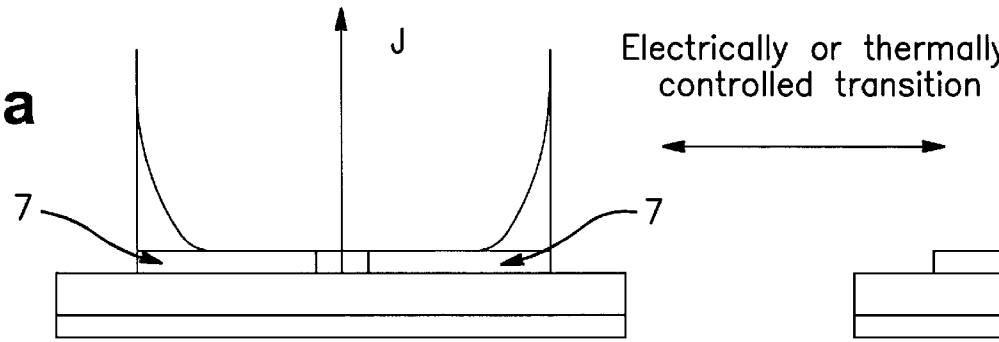
FIG. 2*a* is a cross-sectional view identical to that of FIG. 1 illustrating electrical current distribution when some regions are in a superconducting state.
Figure 2B:
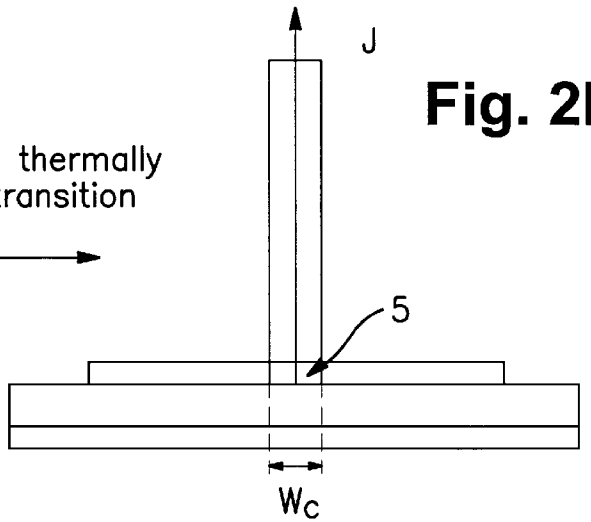
FIG. 2*b* is a cross-sectional view similar to that of FIG. 2*a* illustrating electrical current distribution when some regions have changed from a superconducting state to a normal state.

When the regions 7 are in a superconducting state, all of the electrical current passes in the lateral superconducting areas 7, and at the outer edges thereof, (see the current distribution (J) in the diagram of FIG. 2*a*), according to the Meissner effect.

Figure 3:
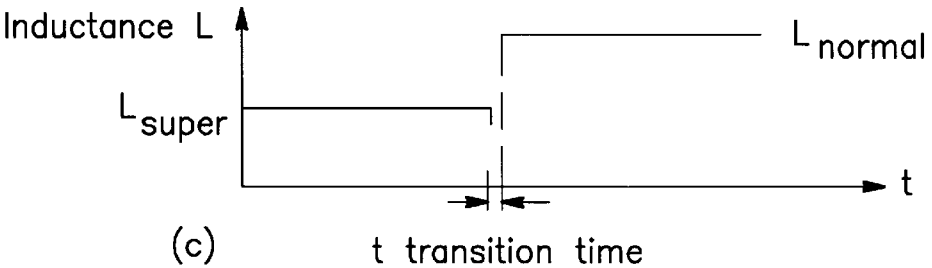
FIG. 3 is a diagram of the inductance of an inductor as a function of time illustrating the case where some regions of an inductor change from a superconducting state to a normal state.

The inductance (L) of a microstrip line is mainly determined by the total width W of the line, e.g., being approximately inversely proportional to the width, provided that the height h of the dielectric 1 is fixed. Thus, changing the state of the potentially superconducting regions 7 changes the inductance (L) of the microstrip line between a lower and a higher value over time (t) as shown in the diagram of FIG. 3.

A switching between the superconducting state and the normal state of the potentially superconducting regions 7 can be achieved in any conventional way, such as by varying the temperature, by varying the magnetic field, or by varying a direct current level as to what is required or desired. This switching is symbolized by the control unit 9 shown in FIG. 1. Preferably, the control unit 9 provides an electrical current higher than the critical current of the superconducting material so that it passes through the microstrip line. With a fixed bias current having an intensity slightly lower than that of the critical current passing through the line, and by adding (or not adding) thereto a small control current such as a current pulse, the reversible switching between the superconducting state and the normal state can be made extremely fast. The general appearance of the switching operation appears in the diagram of FIG. 3. When the regions 7 of the microstrip line are in a superconducting state, the microstrip line has a first low inductance $L_{super}$. When the state is changed to normal, the inductance is changed to a higher value $L_{normal}$. There is a small transition time $\tau$ before the change of inductance is actually effected, for instance when the current through the microstrip line is suddenly increased.

Numerical simulation has indicated that the inductance L of a microstrip line can be easily doubled for a suitable width of the superconducting regions 7, working at microwave frequencies. herein, it is realized that numerous additional advantages, modifications and changes will readily occur to those skilled in the art. Therefore, the invention in its broader aspects is not limited to the specific details, representative devices and illustrated examples shown and described herein. Accordingly, various modifications may be made without departing from the spirit or scope of the general inventive concept as defined by the appended claims and their equivalents. It is therefore to be understood that the appended claims are intended to cover all such modifications and changes as fall within a true spirit and scope of the invention.

What is claimed is:

1. An inductor for microwaves, comprising a microstrip line disposed on a substrate and having the shape of a substantially straight strip of a uniform width, the microstrip line having an input end for receiving an incoming microwave and an output end for forwarding a microwave incoming to the input end, the microstrip line having opposite first and second sides between the input and output ends, the microstrip line further including an electrically conducting material that does not exhibit superconducting properties above a particular temperature; and two strip-shaped regions formed on the substrate in the same plane as the microstrip line that is substantially parallel to a surface of the substrate, one of the two strip-shaped regions located at and in direct connection with the microstrip line along the first side of the microstrip line and another of the two strip-shaped regions located at and in direct connection with the microstrip line along the second side of the microstrip line, the two strip-shaped regions including a material that exhibits superconducting properties above the particular temperature.

2. The inductor of claim 1, wherein the two strip-shaped regions have uniform widths.

3. The inductor of claim 2, wherein the two strip-shaped regions have a same width.

4. The inductor of claim 1, wherein the microstrip line is a metal.

5. The inductor of claim 4, wherein the microstrip line is one of copper, silver, and gold.

6. The inductor of claim 1, wherein the regions include high temperature superconducting material.

7. The inductor of claim 1, further comprising: a controller for controlling an electrical current flow through the inductor, so that when the two strip-shaped regions are in superconducting state, an inductance of the inductor is a first value, and when the two strip-shaped regions change to a non-superconducting state, the inductance is a second value higher than the first value.

8. A method of regulating an inductance of an microstrip line including a substrate, electrical conducting material formed on the substrate, and superconductive regions formed on the substrate adjacent to and in a same plane as the microstrip line, comprising changing an effective width of the microstrip line by changing a state of the superconductive regions, thereby changing the inductance of the microstrip line.

9. The method in claim 8, wherein the state is a superconductivity state.

10. The method in claim 8, further comprising lowering the inductance, by changing the state to a superconductive state and raising the inductance by changing the state to a non-superconductive state.

11. The method in claim 10, wherein the change is accomplished by varying a temperature associated with the superconductive regions.

12. The method in claim 10, wherein the change is accomplished by varying a magnetic field associated with the superconductive regions.

13. The method in claim 10, wherein the change is accomplished by varying an electrical current associated with the microstrip line.

* * * * *